United States Patent [19]

Blum

[11] Patent Number: 4,998,452

[45] Date of Patent: Mar. 12, 1991

[54] CARTRIDGE AND MAGAZINE APPARATUS FOR STORAGE AND AUTOMATIC FEED OF SCREW FASTENERS

[76] Inventor: Kurt E. Blum, 907 E. Burton St., Murfreesboro, Tenn. 37130

[21] Appl. No.: 399,024

[22] Filed: Aug. 28, 1989

Related U.S. Application Data

[63] Continuation-in-part of Ser. No. 173,574, Mar. 25, 1988, abandoned.

[51] Int. Cl.[5] ..... B25B 23/02

[52] U.S. Cl. ..... 81/57.37; 206/338; 206/820

[58] Field of Search ..... 81/57.37, 434; 221/232, 221/279; 29/240, 813; 206/338, 345-347, 820

[56] References Cited

U.S. PATENT DOCUMENTS

| | | | |
|---|---|---|---|
| 2,777,484 | 1/1957 | Gruneman | 81/57.37 |
| 3,891,014 | 6/1975 | Gunn | 221/232 X |
| 4,047,611 | 9/1977 | Damratowski | 81/434 X |
| 4,478,112 | 10/1984 | Moulton | 81/57.37 |

FOREIGN PATENT DOCUMENTS

| | | | |
|---|---|---|---|
| 2027642 | 9/1971 | Fed. Rep. of Germany | 81/57.37 |

*Primary Examiner*—James G. Smith
*Attorney, Agent, or Firm*—Mark J. Patterson

[57] ABSTRACT

An apparatus for storage and automatic feeding of screws into an electric screwdriver comprises a plurality of re-usable or disposable cartridges with internal means for retaining and centering a screw. A magazine holes an upwardly biased column of cartridges.

1 Claim, 3 Drawing Sheets

CARTRIDGE AND MAGAZINE APPARATUS FOR STORAGE AND AUTOMATIC FEED OF SCREW FASTENERS

This is a Continuation-in-Part of co-pending U.S. Application Ser. No. 07/173,574, filed on Mar. 1988, now abandoned.

BACKGROUND OF THE INVENTION

The present invention relates to the use of a screw cartridge and magazine for automatic loading of screw fasteners into an electric screwdriver or similar rotary tool.

The use of electric drills and electric screwdrivers in driving and removing screw-type fasteners has increased in recent years because of their speed and convenience. Their use in the commercial construction industry has not been as widely accepted because of the lack of tools which incorporate a means of storing and automatically feeding the fasteners into the tool. For example, it is widely recognized that screws are preferred over nails in attaching drywall or sheet rock, yet the latter fastener is used more often, because they have been faster to use.

A number of mechanisms for automatic feeding of screw fasteners have been described in the prior art. For example, U.S. Pat. No. 3,757,407 discloses a screw magazine that is attachable to an electric drill. However, it is not readily adaptable to screws of varying sizes, and it requires multiple adjustments for proper positioning and orientation of the fasteners in front of the driving bit.

Similarly, the devices described in U.S. Pat. Nos. 3,907,014 and 3,526,257 involve complex mechanisms to orient the screws properly for use.

U.S. Pat. No. 3,812,961, issued to J. I. Merrick, et al., discloses a screw package but not separable screw cartridges mounted within a self-contained screw cartridge magazine. Although this prior art seeks to allow a convenient method of providing access to plural screws, flexibility was not provided.

U.S. Pat. No. 4,478,212, issued to A. D. Moulton, discloses a fastener feeder that is fixedly attached to the top of a standard drill. This prior art seems specifically intended for industrial use in its complexity and probable expense. The Moulton feeder provides for loading of fasteners only through a clip placed in magazine portion of feeder. Also, holder can not be used independently from feeder.

U.S. Pat. No. 3,891,014 issued to D. T. Gunn for a power screwdriver and U.S. Pat. No. 4,047,611 issued to H. I. Damratowski for an air-powered self-feeding screw driving tool disclose prior attempts to provide auto-feed screw fasteners for principally industrial use. The screw packages disclosed cannot be used independently of the two respective feeders.

West German Patent No. 2,027,642 issued to C. Fein, et al., discloses an automatic feeder specifically intended for strips of screw fasteners. The Fein disclosure provides a single loading orifice, thereby preventing use with a single screw.

U.S. Pat. No. 2,777,484 issued to G. S. Groneman discloses a power operated screw driving attachment. The Groneman device discloses a single method of loading screws through an elongated slot.

What is needed, then, is a simple and inexpensive mechanism for storing and automatic feeding of screws in an electric screwdriver that can easily be used with a wide variety of screws without the need for additional adjustment, attachments, or alignment mechanisms.

It is therefore an object of the present invention to provide a simpler and less expensive cartridge and magazine apparatus for storage and automatic feed of screw fasteners.

It is a further object of the present invention to provide an automatic-feeding screwdriver that can be used without a continuous strip of screw fasteners.

It is still a further object of the present invention to provide an automatic-feeding screwdriver with multiple loading orifices to be used for the loading of single as well as plural screw fasteners.

It is a further object of the present invention to provide a disposable cylindrical cartridge that is as long or longer than the screw that it contains and held in place by a rupturable membrane that would facilitate the driving of self-tapping screws by a power screwdriver with or without an automatic feed.

Still a further object of the present invention is to provide an automatic-feeding screwdriver that does not require fixed attachment to the drill or rotary machine.

A still further object of the present invention is to provide a screw fastener cartridge that is inexpensive to produce and reusable.

SUMMARY OF THE INVENTION

In the present invention, a cylindrical cartridge is sized to universally receive a variety of screw fasteners. Within the cartridge is a flexible collar means which centers and temporarily retains the fastener within the cartridge until pressed out by a driving bit on an electric screwdriver. A plurality of screw cartridges are loaded into a storage magazine, also of universal size. The column of screw cartridges is spring biased upward from the base of the magazine to automatically place each cartridge and screw in proper position. The magazine slides into or is attached to a custom-designed or add-on automatic screwdriver device which drives the screw and ejects the cartridge, which can be of disposable or re-usable construction.

DESCRIPTION OF THE PREFERRED EMBODIMENT

Figure 3:
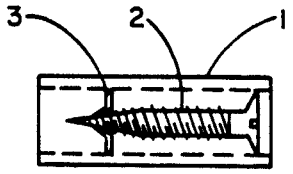
FIG. 3 is a side phantom view of a screw cartridge showing the installed screw and retaining collar.
Figure 5:
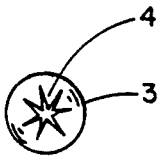
FIG. 5 is a front view of a screw retaining collar or rupturable membrane.
Figure 4:
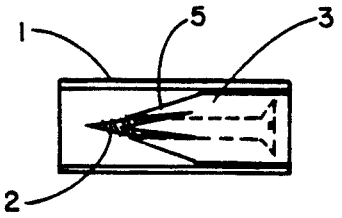
FIG. 4 is a side phantom view of the screw cartridge showing the screw retained by a spider-type retaining collar.

In the present invention, as best seen in FIGS. 3 and 4, a screw cartridge 1 made of aluminum, plastic, or other lightweight, durable material, is cylindrically shaped and sized to universally accommodate screw 2 of varying lengths and diameters. Concentrically secured within cartridge 1 is screw retaining means 3 which loosely centers and retains screw 2. Retaining means 3, as seen on FIGS. 3 and 5, can be a single planar paper or flexible plastic collar with tapered perforations defining flexible fingers 4. Fingers 4 retain screw 2 until driven out, and retain their shape for reuse. Alternatively, screw retainer means 3 can comprise an internally positioned cylinder with spider-type fingers 5, as seen on FIG. 4, for greater durability.

In either case, fingers 4 and spider fingers 5 are flexible enough to allow the head of screw 2 to be driven through cartridge 1. It is also possible to premount the screw retaining means on each of the screws before loading into the cartridges. It can be seen that the dimensions of cartridge 1 and retaining means 3 can be selected so that a single cartridge and retaining means combination can accommodate a wide variety of screw shapes for both commercial and home applications.

Where it is preferred that disposable cartridges be used, retaining means 3 can be simply a self-destructing, rupturable membrane for greater simplicity and lower cost. Retaining means 3 can also be constructed by conventional punching or cutting a hole in a membrane (not shown) shaped similarly to an asterisk (*). Cartridge 1 can be used independently of magazine 6 to drive screw 2 using a conventional drill, screwdriver, or other rotary power tool (not shown). A clear material can be used to make cartridge 1 to allow user to see screw 2 to accurately place screw 2 into receiving material (not shown)

Figure 1:
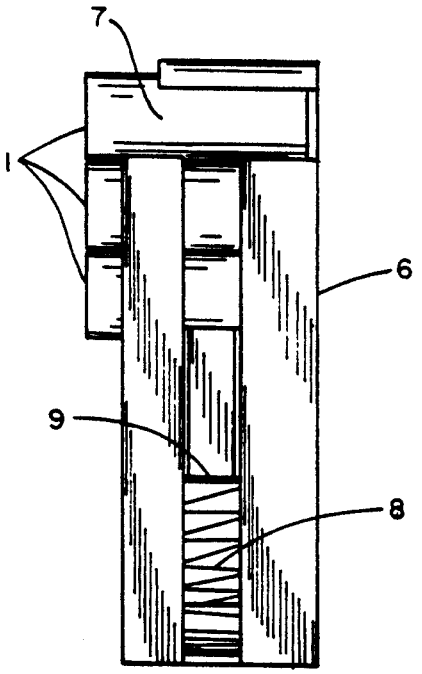
FIG. 1 is a side view of the storage magazine partially filled with screw cartridges.
Figure 2:
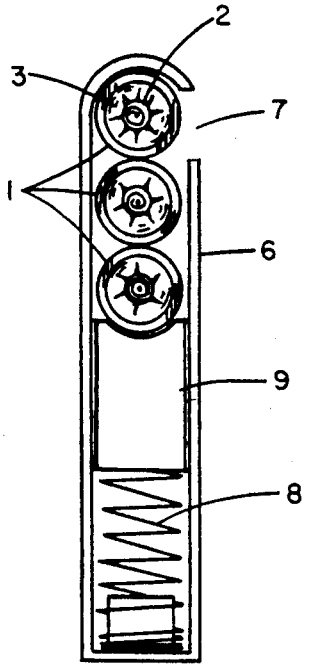
FIG. 2 is a front view of the storage magazine partially filled with screw cartridges.

After a plurality of cartridges 1 are loaded with the desired size of screw 2, they in turn are inserted into chamber 21 of magazine 6, shown in FIGS. 1 and 2, either from the bottom or through loading slot 7 placed adjacent to chamber 21 in the preferred embodiment. The internal dimensions of chamber 21 of magazine 6 are chosen to conform to the shape of cartridge 1. Therefore, a single size magazine 6 can be used to store and feed screws of varying sizes and shapes without requiring any adjustments when changing sizes. The column of cartridges 1 within magazine 6 are moved upward by spring 8 biasing base 9. Consequently, as each screw 2 is driven and cartridge 1 ejected, a new cartridge and screw are automatically moved into position.

Figure 7:
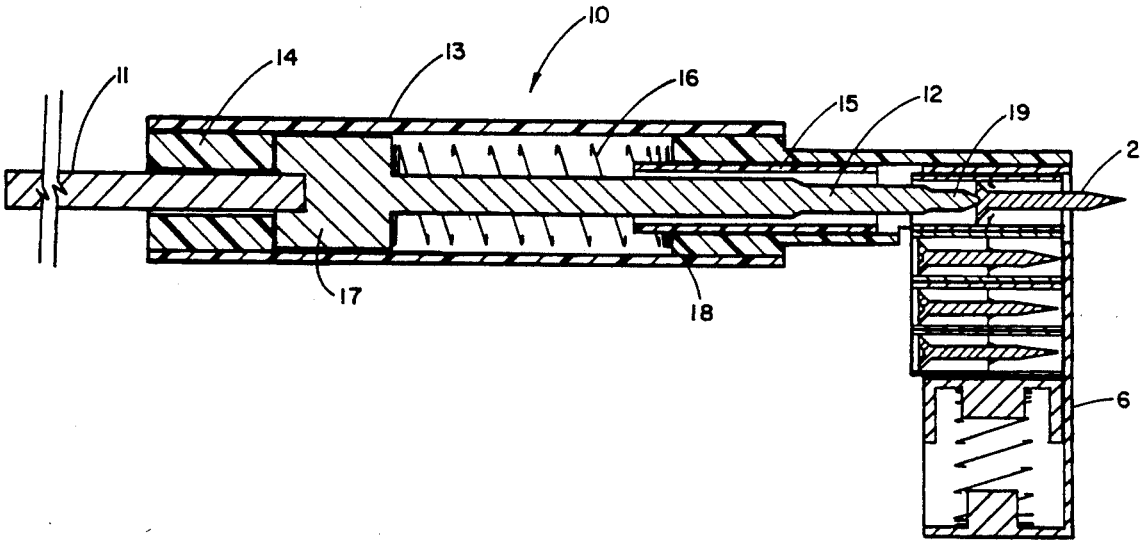
FIG. 7 is a cutaway side view of an automatic feeding screwdriver adapted for attachment to a conventional electric drill.

FIG. 7 demonstrates how magazine 6 can be integrated into an auto-feeding screwdriver 10 without the need for adjustment screws, complex feeding mechanisms, or the like. The screwdriver in FIG. 7 is an example of one which can be attached to a conventional electric drill, although the apparatus described and claimed herein can be used with or incorporated in a variety of rotary tools. As shown, shank 11 is inserted into the chuck of the drill or other rotary tool being used (not shoWn). Shank 11, in turn, drives screwdriver shaft 12 which is slidably mounted within cylinder 13 through coaxial collars 14 and 15. Shank 11 is attached into bore placed in cylindrical stop 17. Spring 16 biases shaft 12 away from chamber 21. Cylindrical stop 17, which is attached to shaft 12, and stop 18, which is not, retain shaft 12 within cylinder 13.

When magazine 6 is loaded, the drill is positioned against the work surface and pushed forward slightly. This engages driving bit 19 against the head of screw 2 within cartridge 1. After screw 2 is driven, the drill is removed from the work surface, and cylinder 13 can be manually pulled toward the drill, causing shaft 12 to eject cartridge 1 out the front of magazine 6. When spring 16 returns shaft 12 to its normal position, the next cartridge is automatically moved upward.

Figure 8:
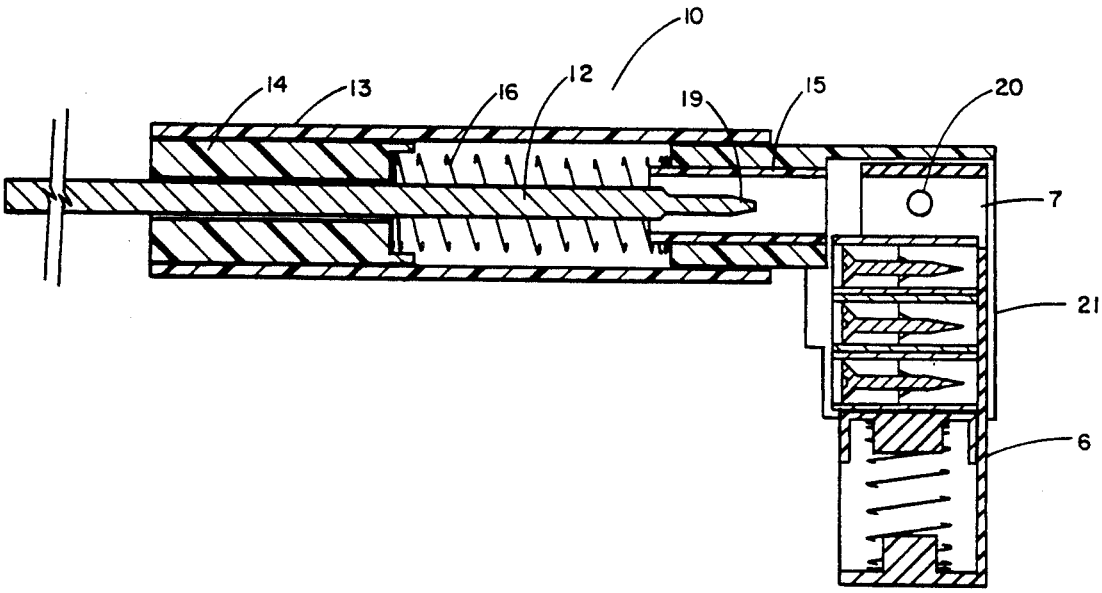
FIG. 8 is a cutaway side view of an automatic feeding screwdriver adapted for attachment to an electric drill using a removable magazine and side-ejection device.

FIG. 8 represents an alternative embodiment of auto-feeding screwdriver 10. In the embodiment of FIG. 8., shaft 12 is placed directly into the chuck of the drill or other rotary tool being used (not shown). Thus, coaxial collars 14 and 15 slidably direct shaft 12 as driving bit 19 advances into and retreats out of coaxial collar 15. Shaft 12 is allowed to slip out of collars 14 and 15 for easier attachment of shaft 12 to drill or rotary tool (not shown). Collar 28 prevents shaft 12 from falling from device 10.

Figure 9:
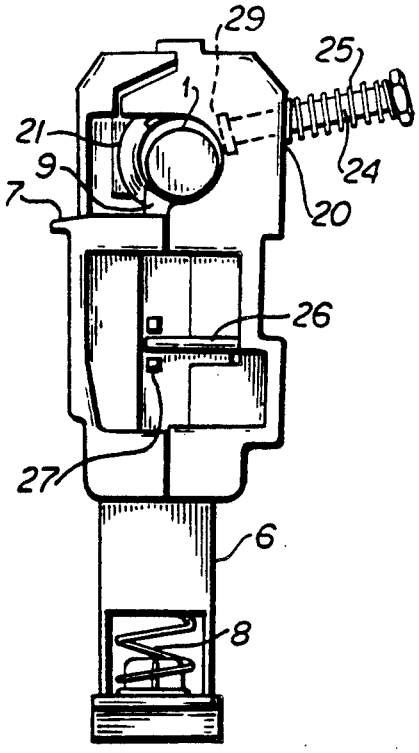
FIG. 9 is an end view of the chamber and magazine of the automatic feeding screwdriver of this invention.

If preferred, as seen on FIG. 9, a spring-loaded ejector 20 can be used to push cartridge 1 laterally through loading slot 7. Spring-loader ejector 20 is finger-push piston 24 placed through hole placed in side of magazine housing 6 opposite slot 7. Spring 25 biases piston 24 out of chamber 21. Stop 29 (shown in phantom) prevents piston 24 from falling out. Cartridge 1 in loaded position is ejected by pushing piston 24 against cartridge 1 and pushing cartridge 1 through slot 7. Loading of magazine 6 is accomplished by inserting magazine 6 through lower side of chamber 21 until rod 26 passes between notch 27.

FIGS. 1, 2 and 9 show that magazine 6 can be used independently of auto-feeding screwdriver 10. User loads cartridge 1 into magazine 6 through slot 7, forcing base 9 downwardly and compressing spring 8. After magazine 6 is fully loaded, user merely places magazine 6 against surface with the tip of screw 2 facing the surface, and the head of screw 2 facing the user. A screwdriver (not shown) of any type can be used to apply screw 2 into surface. After initial screw 2 is applied, used cartridge 1 is ejected out slot 7 by piston 24. Base 9 and spring 8 bias next cartridge 1 into an operational position.

Figure 6:
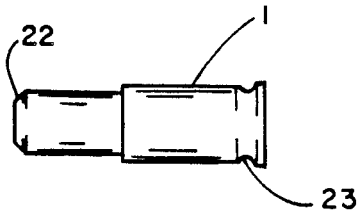
FIG. 6 is a side view of a bullet-shaped screw cartridge.

The scope of the present invention is not confined to cylindrically shaped cartridges, as special exterior features may be added for specific application. For example, in special commercial applications where more precise screw handling may be needed for improved alignment, or for higher speed applications, the present invention can also be adapted for use with conventional bullet-type cartridge feed mechanisms. As seen in FIG. 6, the shape of cartridge 1 is modified to include bevel 22 and groove 23. This permits screw cartridge 1 to be handled by bullet-feed mechanisms which use said bevel 22 and groove 23 to precisely center, align and eject the cartridges.

In either instance, cartridge 1 can be reloaded and reused, if desired.

What I claim is:

1. An apparatus for holding, feeding, and centering screws in cartridges for use with a powered drill having a chuck comprising:

(a) a cylinder having a bore placed through it, said bore having a first end and a second end;

(b) a stop having a forwardly facing surface toward said second end and a rearwardly facing surface toward said first end slidably received and directed by said bore;

(c) means for preventing said stop from exiting said first end and said second end;

(d) a shank centrally aligned with said bore and attached to said rearwardly facing surface of said stop, said shank adapted for insertion into said chuck, said shank passing through said first end;

(e) a shaft centrally aligned with said bore and attached to said forwardly facing surface of said stop, said shaft passing through said second end;

(f) means for biasing said stop away from said second end;

(g) a screwdriving bit coaxially attached to said shaft distally from said stop;

(h) a magazine releasably received by said cylinder proximate to said second end, said magazine having a container for receiving said cartridges, said magazine having a chamber aligned with said bore when said magazine is received by said apparatus;

(i) said bit adapted for engagement of said screws in said cartridges in said chamber when said magazine is received by said cylinder;

(j) a means for biasing said cartridges toward said chamber;

(k) said chamber having a lateral slot adapted for receiving said cartridge not held in said container and discarding said cartridges from said chamber;

(l) means for ejecting said cartridges from said slot of said magazine; and (m) said ejector means comprising a finger-push piston placed through a hole inside of said magazine placed adjacently to said chamber and biased away from said magazine by a spring.

* * * * *